United States Patent [19]

Moen

[11] 4,148,110

[45] Apr. 10, 1979

[54] ROTATING SCRAPING OR ABRADING TOOL

[76] Inventor: Asbjørn Moen, Tasen terrasse 19, Oslo 8, Norway

[21] Appl. No.: 768,882

[22] Filed: Feb. 15, 1977

[30] Foreign Application Priority Data

Mar. 2, 1976 [NO] Norway ..... 753000

[51] Int. Cl.[2] ..... A47L 9/04

[52] U.S. Cl. ..... 15/385; 15/236 C; 15/344

[58] Field of Search ..... 15/236 R, 236 B, 236 C, 15/93 R, 344, 385, 180; 51/174, 177, 209 R, 209 DL; 29/816; 144/118

[56] References Cited

U.S. PATENT DOCUMENTS

| | | | |
|---|---|---|---|
| 1,290,990 | 1/1919 | Hickey | 51/209 R |
| 2,153,207 | 4/1939 | Petty | 15/180 |
| 2,618,005 | 11/1952 | Harshbarger | 15/236 R |
| 2,664,586 | 1/1954 | Prins et al. | 15/93 R X |
| 2,831,451 | 4/1958 | May | 15/93 R X |
| 3,909,875 | 10/1975 | Rother et al. | 15/180 X |

FOREIGN PATENT DOCUMENTS

| | | | |
|---|---|---|---|
| 2144354 | 4/1972 | Fed. Rep. of Germany | 15/344 |

*Primary Examiner*—Christopher K. Moore
*Attorney, Agent, or Firm*—Haseltine, Lake & Waters

[57] ABSTRACT

A rotary scraping or abrading tool in which a rotatable disc has a multiple of guiding bores through which scraping elements are axially arranged. The scraping elements have outer active ends extending beyond the face of the disc facing the workpiece to be treated. Inner ends of the scraping elements bear against a disc of elastic material. The scraping elements are provided with axial play within the bores which are arranged as coacting sets of holes in at least two adjacent parallel discs. The scraping elements are in the form of circular cylindrical tubular studs with a scraping end cross-cut and with an inner end thereof having a head. The cross section of the head exceeds the cross section of the remainder of the stud. The bores, moreover, have an axis at an acute angle relative to the direction of rotation of the discs.

3 Claims, 3 Drawing Figures

FIG. 1.
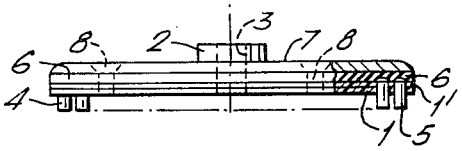
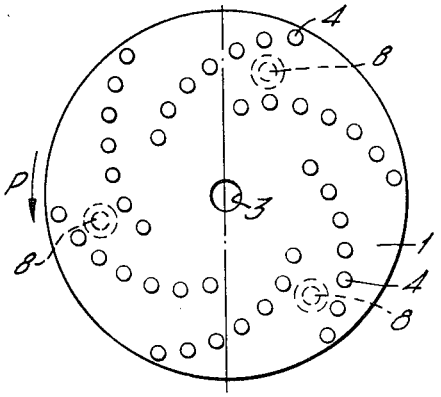
FIG. 1A.
FIG. 2.
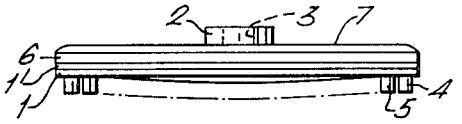
FIG. 3.
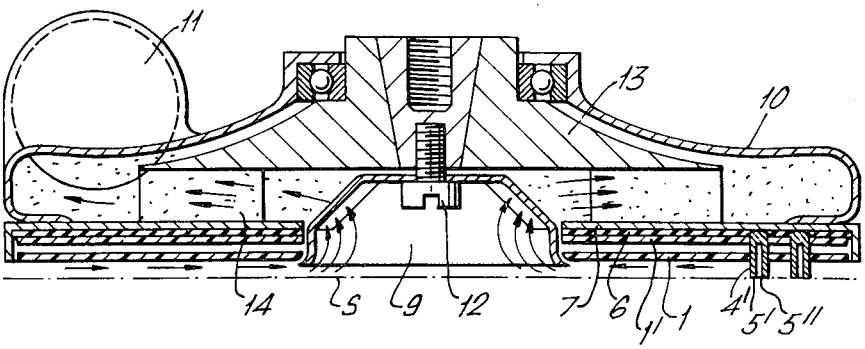

ROTATING SCRAPING OR ABRADING TOOL

BACKGROUND OF THE INVENTION

The present invention relates to a rotating scraping or abrading tool consisting of a motor driven rotatable disc in which scraping elements are axially flexibly supported in bores in the disc, the free active outer ends of said scraping elements projecting from said disc while their inner ends rest against an elastic material.

Removing paint, especially outdoor on houses, but also on boats or the like, is very long-winded and time-consuming work. Usual practice has been manually scraping by means of hand scrapers in case combined with different chemical means or use of heat. It is also possible to use scraping or abrading equipment as, for instance, motor driven rotating members to which is secured for instance abrasive cloth, but comsumption of such abrasive cloth is large due to wear and clogging of the abraded paint to the active paper surface or the like.

These methods have in common that they are both very time-consuming and therefore expensive. The use of chemicals or heat further can involve with danger.

SUMMARY OF THE INVENTION

The present invention is based on mechanical removal of paint, varnish or other coating by means of a rotating scraping tool. This tool can also be used for a series of other objects, for instance, grinding down of wood or other materials, cleaning of shuttering materials, scraping of rust. According to the decided range of use, the scraping tool may have different form and size.

There are already known in the art rotating scrapers having motor driven rotatable discs with various kinds of scraping or abrading elements. Such elements are in the form of spikes protruding from holes in a plate and being provided with heads having a compliant or elastic support. Such support is also known for scraping elements having another form, for instance, triangular pegs. There are also known peg-like abrading elements which are hollow or tube-like.

It is the object of the invention to provide such a tool as mentioned above with a series of advantages beyond the state of the art. According to the invention, the scraping elements have a substantially more active scraping surface. The elements thus can be self-adjusted, so that they will take the most favorable scraping position, being freely rotatable in their journallings or support in the tool; at the same time the elements can adapt themselves to the scraping action by their further possibility of movement. The elements can also be given a desired prepositioning by such adjustment means as described in the following with reference to the drawing.

BRIEF DESCRIPTION OF THE DRAWINGS

FIG. 1 shows a side elevation partly in section illustrating a scraping tool according to the invention.

FIG. 1*a* shows a plan view of the bottom of the scraping tool, shown in FIG. 1.

FIG. 2 shows a side elevation of a modified embodiment of the tool according to FIG. 1.

FIG. 3 is a cross-section in larger scale through a scraping tool according to the invention, in which further features incorporated therein appear.

FIG. 4 shows a side and top view of the arrangement for adjusting inclination of pegs on scraping;

FIG. 5 shows an embodiment of the invention with fan blades near center of disc;

FIG. 6 shows an embodiment with vacuum suction equipment; and

FIG. 7 shows an enlarged view of pegs with hard metal elements and elastic elements.

DESCRIPTION OF PREFERRED EMBODIMENT

The scraping tool shown in FIG. 1 consists of two circular base discs 1, 1' having a centric boss 2 which can be provided with means for attaching it to drill or with a threaded bore 3 adapted for a drill or grinding machine. In these discs there are provided a series of holes preferably arranged in spiral design, which holes hold inserted scraping elements in the form of cylindrical teeth or pegs 4 with an active portion 5 of hard metal. The pegs can be arranged in various configurations, but by arranging them in spiral form in relation to the direction of rotation, one will obtain effective removal of dirt and dust from the tool, which are hurled as by a fan from the center of the disc towards the circumference thereof or by opposite rotation, the scraped off material will be directed towards the center of the tool to be removed therefrom as will be described in the following. The diameter of the pegs is so adapted in relation to their distance from the center of the tool that the whole surface worked or machined is covered by the total active surface of the pegs.

To keep the pegs in a good contact against the surface worked, the heads of pegs engage an elastic disc 6, for instance made from rubber. This rubber disc is supported by a rear base plate 7 made from rigid material. The plate 7 is adjustably connected to the discs 1, 1' by means of lockable or locking screws 8, whereby the operating characteristic of the tool can be adjusted; by a harder pressure against the pegs, the scraping or abrading effect is increased. In practice it can be desirable to adjust this pressure thus, the plugs do not penetrate the rubber disc 6, but the top of the plugs (heads) rest against the rubber disc. The distance between the the plates 1' and 7 may be varied, thus controlling the effective elasticity of the rubber disc.

It can further be an advantage to arrange the pegs with a slight rearward sloping in relation to the direction of rotation of the discs. This prevents the pegs cutting into the material of the worked surface.

The pegs are circular and so dimensioned that they can freely rotate in the holes. The life of the pegs is prolonged by the fact that the wearing is distributed around the entire circumference.

For a further embodiment, some of the pegs can be made a little shorter and/or be otherwise different from the rest of the pegs. Such pegs thus might come successively into contact with the surface to be worked according to the variation of the contact pressure. Thus one can at first by a certain pressure on the tool rip up the surface and then reduce the pressure, resulting in a finer finish.

FIG. 2 shows a scraping tool substantially similar to the one shown in FIG. 1 except for the feature that the active working surface is given a slight conical form. The object of this feature is that it is possible to determine in which direction the pegs should scrape the wood-work or the like in relation to the wood fibers. It has been found that if the pegs scrape across the fibers, one will obtain a rough surface similar to sawn material. If the pegs scrapes along the fibers, one will, however, obtain a smooth surface almost as if the surface was planed. For staining or painting of outdoor wooden materials it is usually desirable to obtain a rough surface, while under other circumstances it can be desirable to have a smooth surface. Having a scraping tool with slightly conical form, the direction of work can be determined by giving the tool the right inclination.

FIG. 3 shows in somewhat larger scale a section through a scraping tool according to the invention in which embodiment further modifications are incorporated. The discs according to FIG. 3 are built up substantially according to the same principle as the discs according to FIG. 1, but the two discs 1, 1' are arranged with a certain mutual spacing. The two discs are provided with means (not shown) to give a small rotational displacement in relation to each other, whereby the pegs 4', extending through the bores in both discs 1, 1', will get a correspondingly inclined position. The contact pressure against the elastic disc 6 also can be varied by adjusting the distance between said discs. The adjustment screws 8 described in connection with FIG. 1 can be omitted.

The discs 1, 1' can be made from elastic material. They can be produced with a slight conical form. With the center screw 12 which secures the discs to the central drive disc 13, these discs can be tightened against the driving discs to obtain the desired conical form or plan form for the active scraping surface S. By these means the active surface S of the tool can be adjusted.

Another feature of FIG. 3 is that the discs have a central opening 9 which is surrounded by a closed, stationary housing 10, with a convenient conduit 11 leading to a vacuum cleaner. The discs according to FIG. 3 are then assumed to rotate in opposite direction to the one shown in FIG. 1 with the arrow p, i.e., that the removed material will be hurled against the center of the discs. This results in it will be sucked up and out as suggested by the arrows. This scraping tool is especially fitted for use indoors.

The same effect can be obtained or could be combined with the above mentioned by providing the central drive disc 13 with fan blades 14. This results in a centrifugal fan wheel which transports the dirt and dust from the working area of the pegs 4 to a convenient discharge and accumulation container. As mentioned, this arrangement could be combined with a vacuum cleaner.

In the section disclosed in FIG. 3, the scraping elements have the form of hollow or tube-like cylindrical members 4'. This embodiment is especially favorable because thereby the active scraping edges of the elements 4' can be increased. Thereby not only the active foremost edges 5' scrape the workpiece surface, but also the inner edges 5''.

The scraping tool according to the invention can be produced in various sizes, so that the different surfaces to be treated are conveniently accessible. The tool can have a rotational speed of 2000–3000 r.p.m., but this can of course be varied according to the field of application and/or the dimensions of the tool.

In the above description of the invention, the scraping elements are arranged in coaxial holes in adjacent discs, but one will immediately understand that this arrangement also can be used for a rotating scraping tool based on two or more coaxial cylindrical bodies instead of discs, said cylinders having different diameters so that they can be arranged one inside the other.

What I claim is:

1. A rotary scraping or abrading tool including a disc having a multiplicity of guide means therein through which scraping elements are axially arranged, said scraping elements having outer active ends extending beyond the face of the disc facing the workpiece to be treated, a disc of elastic material, said scraping elements having inner ends bearing against said disc of elastic material, said guide means comprising bores arranged as coacting sets of holes provided in said disc and one adjacent parallel disc, said scraping elements comprising circular cylindrical tubular studs with a scraping end cross-cut and with an inner end thereof having a head, said head having a cross-section exceeding the cross-section of the remainder of the stud.

2. A tool as defined in claim 1 wherein said studs are surrounded by clearance within said bores for providing substantially free rotation of said studs.

3. A tool as defined in claim 1 including a rear base plate, said studs being arranged in a spiral-shaped pattern, said disc having a central portion, a stationary casing, a suction outlet attached to said stationary casing, said central portion of said discs and rear base plate having an opening communicating through an inner space of said tool with said suction outlet.

* * * * *